United States Patent [19]

Axelson

[11] Patent Number: 4,710,611

[45] Date of Patent: Dec. 1, 1987

[54] ARRANGEMENT IN A COOKING PLATE OR HOB HAVING A TEMPERATURE SENSOR

[75] Inventor: Claes J. H. Axelson, Stockholm, Sweden

[73] Assignee: AB Electrolux, Sweden

[21] Appl. No.: 878,589

[22] Filed: Jun. 26, 1986

[30] Foreign Application Priority Data

Jul. 12, 1985 [SE] Sweden ..... 8503462

[51] Int. Cl.[4] ..... H05B 3/70

[52] U.S. Cl. ..... 219/450; 219/518; 219/449

[58] Field of Search ..... 219/450, 448, 449, 516, 219/459, 461, 467, 466, 465, 468, 462, 463, 464, 518

[56] References Cited

U.S. PATENT DOCUMENTS

| | | | |
|---|---|---|---|
| 2,140,479 | 12/1938 | Myers | 219/450 |
| 2,853,879 | 9/1958 | Woods | 219/450 |
| 3,015,710 | 1/1962 | Kelly | 219/450 |
| 3,114,027 | 12/1963 | Busch | 219/450 |

FOREIGN PATENT DOCUMENTS

| | | | |
|---|---|---|---|
| 855926 | 12/1960 | United Kingdom | 219/450 |
| 975526 | 11/1964 | United Kingdom | 219/450 |

*Primary Examiner*—E. A. Goldberg
*Assistant Examiner*—Teresa J. Walberg
*Attorney, Agent, or Firm*—Alfred E. Miller

[57] ABSTRACT

A cooking plate or hob having a temperature sensor, the cooking plate or hob being provided with a central through hole in which a body supporting the temperature sensor is movably arranged. The body is operated by a spring in a direction towards the upper side of the cooking plate or hob, the movement being limited by a shoulder which cooperates with a surface on the body. The surface has a shape that coincides with the envelope surface of a rotating body of curved or conical shape. The shoulder connects to the upper side of the cooking plate or hob and the body takes the form of a cup-shaped thin plate which opens downwards and has a plane upper side and an annular skirt which is adapted to the through hole. The surface which cooperates with the shoulder connects the upper side of the thin plate with its skirt.

4 Claims, 6 Drawing Figures

ARRANGEMENT IN A COOKING PLATE OR HOB HAVING A TEMPERATURE SENSOR

BACKGROUND OF THE INVENTION

The present invention relates to an arrangement of a cooking plate provided with a central hole having a movable temperature sensor therein.

Usually, automatically controlled cooking plates are provided with a temperature sensor which is mounted in a central hole in the cooking plate. The sensor is connected with a thin, cup-shaped plate the upper side of which being plane and in addition being essentially parallel to the cooking surface of the cooking plate. The thin plate is operated by spring means to a position in which the upper side of the plate projects above the cooking surface. By that the spring means will force the thin plate against the lower side of the cooking utensil being placed on the cooking plate. Thereby, a good transfer of heat from the cooking utensil to the thin plate will be insured.

The distance between the upper side of the thin plate and the surface of the cooking plate is determined by a shoulder situated in the central hole. The shoulder cooperates with an annular projection or the like. In U.S. Pat. No. 3,114,027 the temperature sensor is arranged in a cylindrical body having two co-axial parts of different diameter, said parts being axially separated. The part having the smaller diameter is situated closest to the cooking surface. The two parts are separated by a conical part which is directed towards the cooking surface and which cooperates with a conical should in the wall of the hole at some distance into the hole.

In the embodiment disclosed the U.S.-reference a centering of the temperature sensor can be had in order to minimize the influence from the surrounding part of the cooking plate. However, a disadvantage is that a vertical annular clearance develops between the temperature sensor and the wall of the hole and liquid and other impurities can enter and disturb the function of the sensor. In addition, the clearance is narrow and accordingly it is difficult to clean it.

SUMMARY OF THE INVENTION

The object of the invention is to remedy the disadvantages described and to provide an arrangement of the kind referred to in which the clearance between the temperature sensor and the central hole can be easily cleaned and at the same time, in a proper sense any clearance will not develop between the sensor and the wall of the hole when no cooking utensil is being placed on the cooking plate.

BRIEF DESCRIPTION OF THE DRAWINGS

Other objects and advantages will appear from the following detailed description of a few embodiments of the invention will reference to the accompanying drawings, in which.

DESCRIPTION OF THE PREFERRED EMBODIMENTS

Figure 1:
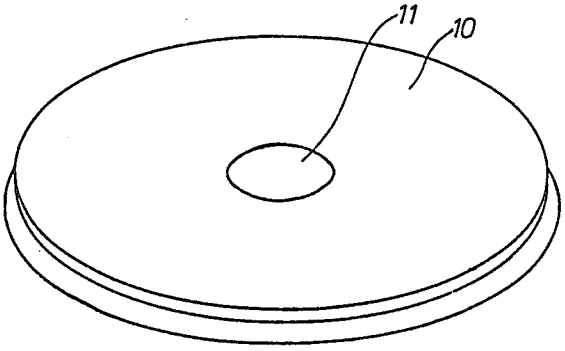
FIG. 1 shows a perspective view of the cooking plate having a temperature sensor.

In FIG. 1 there is shown a cooking plate 10 of the type having in its central part a temperature sensor 11. Different types of sensor elements can be used, for example thermistors of positive or negative temperature coefficient. Also liquid type sensors can also be used.

Figure 2:
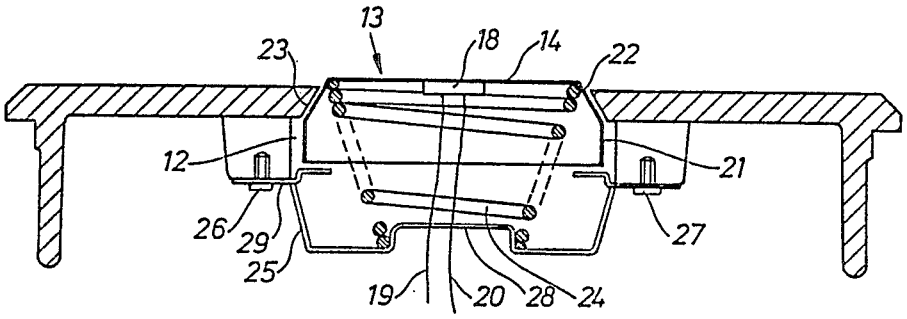
FIG. 2 shows a section of a cooking plate according to FIG. 1 wherein a conical surface on the temperature sensor cooperates with a conical shoulder in the cooking plate adapted to the conical surface.
Figure 6:
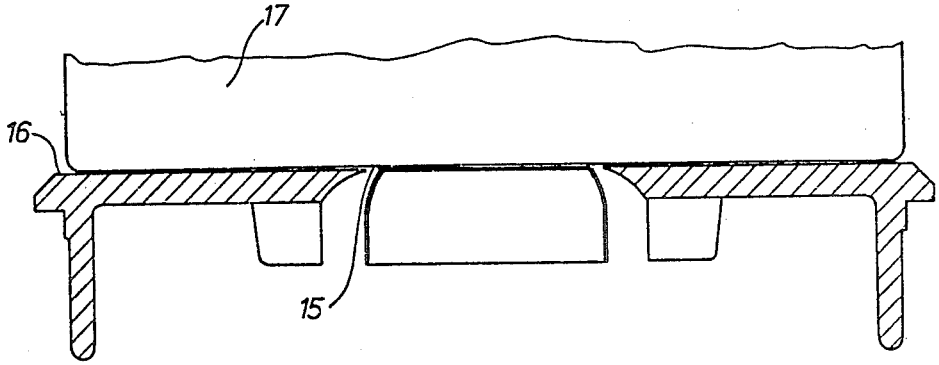
FIG. 6, finally, shows the embodiment of FIG. 4 with a cooking utensil placed on the cooking plate.

FIG. 2 shows a section through a cooking plate 10 according to FIG. 1 having a central hole 12. The temperature sensor is constituted by a body in the shape of a cup-shaped thin plate 13 which opens downwards and which is vertically movable in the hole 12. The plate has an upper side 14 which has a planar and is intended to cooperate with the under side 15 of a cooking utensil 17 which is placed on the cooking surface 16 of the plate (FIG. 6). On the inside of the plate 13 straight in front of its upper side 14 a sensor element 18 is fixed, said element being of the resistance type, for example a Pt-resistor, the connecting wires 19, 20 of which being intended to be connected to a control unit (not shown).

The thin plate 13 has a cylindrical lower part or skirt 21 which is connected with the planar upper part 14 by a conical part 22. This part is intended to cooperate with a conical shoulder 23 arranged in the hole 12. The plate 13 is movable in an upward direction by a spring 24 and the cooperating surfaces 22, 23 limit the movement of the plate such that its upper side 14 will project above the cooking surface 16 of the cooking plate.

A cup 25 is secured to the underside of the cooking plate by screws 26, 27 and forms an abutment for the spring 24. The cup has a projection 28 which constitutes a guide for the spring. Further, an annular plate 29 is fixed to the cooking plate by the screws 26,27. This plate cooperates with the lower cylindrical part 21 of the plate 13 to limit the possible downward movement of the last-mentioned plate such that, at the most, the upper side of the plate can be pressed down about one millimeter below the cooking surface 16 of the cooking plate.

The most important object of the invention is that the plate 13 in its uppermost position shall tightly bear against the surrounding hole 12 in the cooking plate without the development of any clearance in between. For that purpose the conical shoulder has been positioned such that it engages the cooking surface 16 of the cooking plate. In FIG. 2 the two surfaces which cooperate have a conical shape and the conical angles of the surfaces are of the same magnitude. This means that the plate 13 will be centered in its uppermost position. If, however, a pan is placed such that only a minor part of the plate 13 is pressed down, the plate can move sideways due to the fact that the lower part of the plate is not guided sideways. This means that clearances can develop between the plate and the hole at the point of pressing down of the plate and these clearances are open for spillage from the pan.

Figure 3:
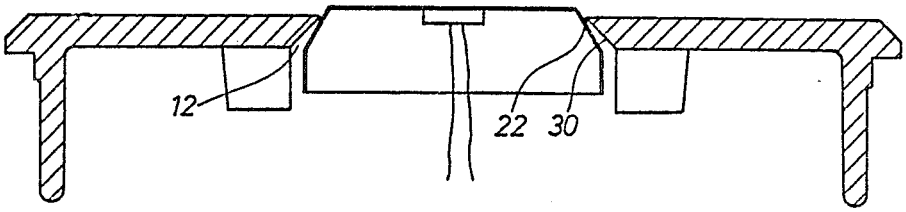
FIG. 3 shows an embodiment similar to that of FIG. 2 but wherein the cone angle for the shoulder is greater than the angle for the surface of the sensor.
Figure 4:
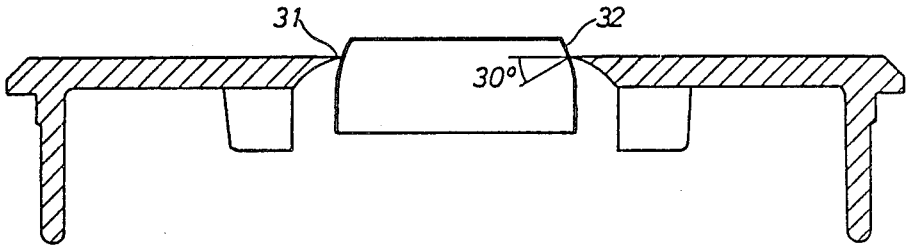
FIG. 4 shows an embodiment wherein the shoulder is constituted by an annular edge while the surface on the sensor has spherical shape.
Figure 5:
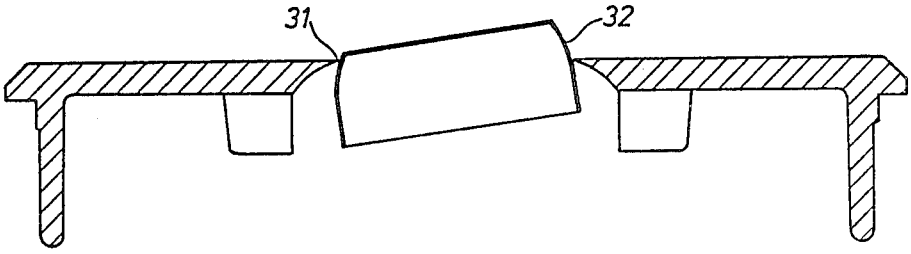
FIG. 5 shows the embodiment of FIG. 4 with the sensor in a slant position.

In FIG. 3 an embodiment is shown wherein the plate 13 can take a slant position without the sealing function being lost. For that purpose the hole has been provided with the conical shoulder 30 which has a greater conical angle than the surface of the conical part 22 of the plate. Therefore, the surface of the plate will sealingly bear against an edge more than against a conical surface and a certain slant positioning can be permitted. A higher degree of slant positioning can be allowed if, as shown in FIG. 4, the shoulder is shaped as a comparatively sharp, annular edge 31 and the surface 32 of the plate 13 that cooperates with the shoulder is given a spherical shape. Then, the radius of curvature is selected such that the center of curvature will be situated as close as possible to the cooking surface 16 of the cooking plate. This results in that the plate 13 can take a slant position without the development of any lateral movement. Such a movement in a lateral direction can appear in the embodiment of FIG. 3 at large slant positions taken by the plate 13 which results in that the sealing function ceases at the side of the hole where the plate is displaced upwards.

As in the embodiment of FIG. 4 it would be suitable in the embodiment of FIG. 3 to give the surface of the plate (13) that cooperates with the shoulder such a shape that the center of tilting for the movement of the plate during the slant positioning is situated as close as possible to the cooking surface of the cooking plate. Especially good results have been achieved in the embodiments according to FIGS. 3 and 4 with the center of tilting being so positioned that the angle between a line interconnecting the contact point between the cooperating surfaces of the shoulder and the plate, respectively, with the center of tilting and a line through the contact point which is parallel to the cooking surface of the cooking plate amounts to about 30°.

The invention has been described with reference to a cooking plate. However, it can as well be used in cooking hobs, for instance of the ceramic type. In this case the conical or annular shoulder can be constituted by a metal sleeve mounted in a hole in the hob.

What is claimed is:

1. In an arrangement in a cooking plate or hob having a temperature sensor, the cooking plate or hob being provided with a central through hole in which a body supporting the temperature sensor is movably arranged, the body being urged by spring means in a direction towards the upper side of the cooking plate or hob, the movement being limited by a shoulder in the boundary surface of the hole, the shoulder cooperating with a surface on the body, said surface having a shape that corresponds with the adjacent envelope surface of said movable body, wherein the improvement comprises said shoulder connecting with the upper side of the cooking plate and the body being constituted of a cup-shaped thin plate which opens downwards and has a planar upper side and an annular skirt which is adapted to be seated in the through hole and wherein the surface which cooperates with the shoulder connects the upper side of the plate with its skirt, and wherein said movable body is a right cone and said shoulder has a conical shape adapted to the cone wherein the cone angle of said shoulder is greater than that of said movable body.

2. Arrangement according to claim 1, wherein the movable body has a spherical shape and the shoulder is constituted by an annular edge.

3. Arrangement according to claim 2, wherein the cooperating surfaces of the shoulder and of the thin plate, respectively, have a shape such that upon slant positioning of the plate the center of tilting for the movement of the plate is situated so close to the cooking surface of the cooking plate that the movement takes place mainly without any lateral movement.

4. Arrangement according to claim 3, wherein the center of tilting is situated such that the angle between a line that connects the contact point between the cooperating surfaces with the center of tilting and the line through the contact point which is parallel to the cooking surface amounts to about 30°.

* * * * *